US009643375B2

(12) United States Patent
Oudsen

(10) Patent No.: US 9,643,375 B2
(45) Date of Patent: May 9, 2017

(54) METHOD AND DEVICE FOR FOLDING A STACK OF SHEETS

(71) Applicant: SDD Holding B.V., Emst (NL)

(72) Inventor: Johannes Franciscus Roland Oudsen, Epe (NL)

(73) Assignee: SDD Holding B.V., Emst (NL)

( * ) Notice: Subject to any disclaimer, the term of this patent is extended or adjusted under 35 U.S.C. 154(b) by 707 days.

(21) Appl. No.: 13/780,399

(22) Filed: Feb. 28, 2013

(65) Prior Publication Data

US 2013/0231234 A1 Sep. 5, 2013

(30) Foreign Application Priority Data

Mar. 1, 2012 (EP) ..... 12157635

(51) Int. Cl.
*B31F 1/00* (2006.01)
*B65H 45/18* (2006.01)

(52) U.S. Cl.
CPC ..... *B31F 1/0003* (2013.01); *B65H 45/18* (2013.01); *B65H 2301/51212* (2013.01); *B65H 2701/13212* (2013.01); *B65H 2801/27* (2013.01)

(58) Field of Classification Search
CPC ..... B31F 1/0003; B65H 45/18; B65H 2701/13212; B65H 2301/51212; B65H 2801/27; B65H 2301/51232; B65H 45/30
USPC ..... 493/424, 425, 426, 442, 427, 434, 438
See application file for complete search history.

(56) References Cited

U.S. PATENT DOCUMENTS 4,641,575 A * 2/1987 Cavagna ..... B26D 5/04 101/23
5,520,604 A * 5/1996 Reist ..... B65H 45/30 493/422
6,709,375 B2 * 3/2004 Groenenberg ..... B65H 45/30 493/144
7,798,950 B2 * 9/2010 Kobayashi ..... B65H 45/18 270/20.1
7,802,779 B2 * 9/2010 Kamiya ..... B42C 1/12 270/32
2006/0104685 A1 * 5/2006 Holtman ..... B41J 11/485 399/384
2006/0263174 A1 * 11/2006 Oikawa ..... B42C 5/00 412/33
2010/0104399 A1 4/2010 Ryan
2011/0218091 A1 9/2011 Taguchi et al.

FOREIGN PATENT DOCUMENTS

EP 2388221 A1 11/2011

* cited by examiner

*Primary Examiner* — Thanh Truong
*Assistant Examiner* — Thomas Wittenschlaeger
(74) *Attorney, Agent, or Firm* — The Webb Law Firm

(57) ABSTRACT

Provided herein is a device for folding a stack of sheets. The device includes a frame, means for pre-folding a stack of sheets along a crease line into a main plane such that a booklet with a straight back is obtained, means for keeping the pre-folded booklet relative to the frame, a carriage movably arranged to the frame and moveable parallel to the back of the booklet, and a nip arranged to the carriage for receiving the back of the pre-folded booklet. The nip direction forms an angle greater than zero with respect to a direction of movement of the carriage.

5 Claims, 3 Drawing Sheets

METHOD AND DEVICE FOR FOLDING A STACK OF SHEETS

The invention relates to a method for folding a stack of sheets.

For finishing printed paper and press work, it is widely known to feed the sheets to a finishing station. Such a finishing station typically could stack the sheets into a stack of sheets, provide staples to attach the sheets to each other, trim edges and fold the stack of sheets into a booklet.

For folding a stack of sheets into a booklet, a number of techniques are known. An often used technique for folding sheets supplied by a printer is the knife folding technique. The sheets supplied by the printer are stacked and transported near two parallel rollers. A knife blade will then push in the center of the stack, such that the center of the stack of sheets is fed to the parallel rollers and a crease is arranged in the stack of sheets.

To sharpen the crease in the folded stack of sheets, the stack could be fed to secondary rollers, which are pressed together under a higher force, than the first rollers. This increased force will sharpen the crease. This is for example known from US 20100104399.

Another aspect to improve the crease is to ensure that the grain orientation is correct relative to the crease. The grain orientation is the direction in which most of the fibers lie. The grain orientation is determined during the papermaking process, when fibers tend to align in one direction or the other. If the grain orientation is perpendicular to the crease, the resulting crease will be substantially sharper than if the grain orientation is parallel to the crease. So, with the known folding methods it is necessary to orient the sheets to get the best results.

The techniques used for printing sheets of paper are constantly improved. One of these techniques provides printed sheets of paper having a glossy appearance. To achieve the glossy appearance a wax-like material is added to the toner of the printer. The wax-like material provides the glossy appearance, but also reduces the friction between sheets. Other printers provide a finishing layer over the full surface of the sheet, which also reduces the friction between the sheets. Although this reduction in friction is advantageous for some applications, it is of disadvantage for the used folding techniques.

When sheets of paper, having this reduced friction, are folded with the knife folding technique, the outer sheets tend to slide over each other. This results in a reduced quality of the crease and could even lead to rupture of some of the sheets.

EP 2388221 discloses a folding device, which is also called a square back folding machine. After the stack of sheets is pushed by a knife blade through two nip rollers, the back of the folded booklet is further processed by a carriage having rollers pressing in three directions. Two sets of rollers are arranged on opposite sides of the booklet to fixate the back of the booklet while a third roller pushes at the back of the booklet. This causes a flat side on the back of the booklet.

This square back folding machine also suffers from the new printing methods providing the glossy sheets of paper.

It is now an object of the invention to provide a folding method for folding a stack of sheets, in which the above mentioned disadvantages are reduced or even prevented.

This object is achieved with a method according to the invention, the method comprising the steps of:

pre-folding the stack of sheets along a crease line into a main plane such that a booklet with a straight back is obtained;

urging a part of the back into a meandering pattern, wherein the meandering pattern is caused in a secondary plane perpendicular to the main plane;

and subsequently releasing the part of the back, such that the part of the back may return to a straight back part.

When a sheet of paper is folded, the fibers in the sheet will break around the crease line, which will ensure that the crease stays in the sheet. The known methods for folding in combination with the new printing methods, do not make the crease deep enough in the sheet of paper.

With the invention an additional deformation of the sheet is caused by imparting a meandering pattern to a part of the back. This will break additional fibers in the sheet such that the crease will be made deeper.

The folding method according to the invention has a further advantage that the quality of the resulting crease is less or no longer dependent on the grain orientation of the paper sheets. The fibers are broken in multiple directions by imparting the meandering pattern, such that the grain orientation is less of no longer relevant for a high quality crease.

A preferred embodiment of the method according to the invention comprises the step of repeating the urging and releasing steps for adjacent parts of the back along the length of the back.

The meandering pattern is urged along the full length of the back of the booklet, such that additional fibers over the full length are broken and the crease is further improved.

Yet another embodiment of the method according to the invention further comprises the step of urging the part of the back into a mirrored meandering pattern.

When the fibers are bent in one direction by the meandering pattern, the same fibers could break when bent in the other direction. By imposing also a mirrored meandering pattern further fibers are broken and the crease is improved.

In another embodiment of the method according to the invention the line of intersection of the main plane and the secondary plane is the crease line.

The invention further relates to a device for folding a stack of sheets according to the method of the invention, the device comprising:

a frame;

means for pre-folding a stack of sheets along a crease line into a main plane such that a booklet with a straight back is obtained;

means for keeping the pre-folded booklet relative to the frame;

a carriage movably arranged to the frame, wherein the carriage is movable parallel to the back of the booklet; and a nip arranged to the carriage and for receiving the back of the pre-folded booklet, wherein the nip direction is under an angle with the direction of movement of the carriage.

With the device according to the invention it is possible to make a first crease in the stack of sheets and then to improve the crease with the nip. The carriage runs along the length of the back of the booklet, such that the back is fed into the nip arranged on the carriage. Because the nip direction is under an angle with the direction of movement of the carriage, part of the back, which is between the nip, will be bent. This bending causes additional breakage of the fibers improving the crease.

When the carriage moves along the back of the booklet, still another part of the back is bent and then allowed to straighten out. This causes the back part to have a meandering pattern.

In a preferred embodiment of the device according to the invention the nip comprises at least two spring mounted nip rollers. The nip rollers will guide the back of the booklet into the meandering pattern without damaging the outer sheets of the booklet, while the springs ensure that a sufficient pressure is put on to the back of the booklet to make the crease.

The nip rollers could be provided with a peripheral groove or rib to form a desired pattern in the back of the booklet.

In another preferred embodiment of the device according to the invention the nip is arranged with a tiltable arm to the carriage, such that the nip direction is mirrored upon reversal of the direction of movement of the carriage.

With this embodiment, the carriage can be moved up and down the back and with each change of direction of the carriage, the tiltable arm will swap position, such that the nip direction is mirrored. With the mirrored nip direction, a mirrored meandering pattern is imposed on the back of the booklet. So, by moving the carriage once up and down, both the meandering pattern and the mirrored pattern is imposed on the back of the booklet.

By repeating the up and down movement of the carriage on a single booklet, the quality of the crease is improved. The number of times depends on the number of sheets in the booklet.

In still another embodiment of the device according to the invention the means for pre-folding a stack of sheets comprise two parallel primary rollers and a knife plate movable into the nip of the parallel primary rollers.

Preferably, the device according to the invention further comprising secondary parallel rollers arranged, relative to the carriage, opposite of the primary parallel rollers, wherein the secondary rollers are for further transporting the folded booklet.

In a further preferred embodiment of the device according to the invention the secondary rollers are driven through a unidirectional bearing. With this unidirectional bearing the secondary rollers could be driven at a somewhat lower speed than the primary rollers. This ensures that the secondary rollers will not pull the booklet out of the grip of the primary rollers, which could cause the booklet to be damaged.

These and other features of the invention will be elucidated in conjunction with the accompanying drawings.

Figure 1:
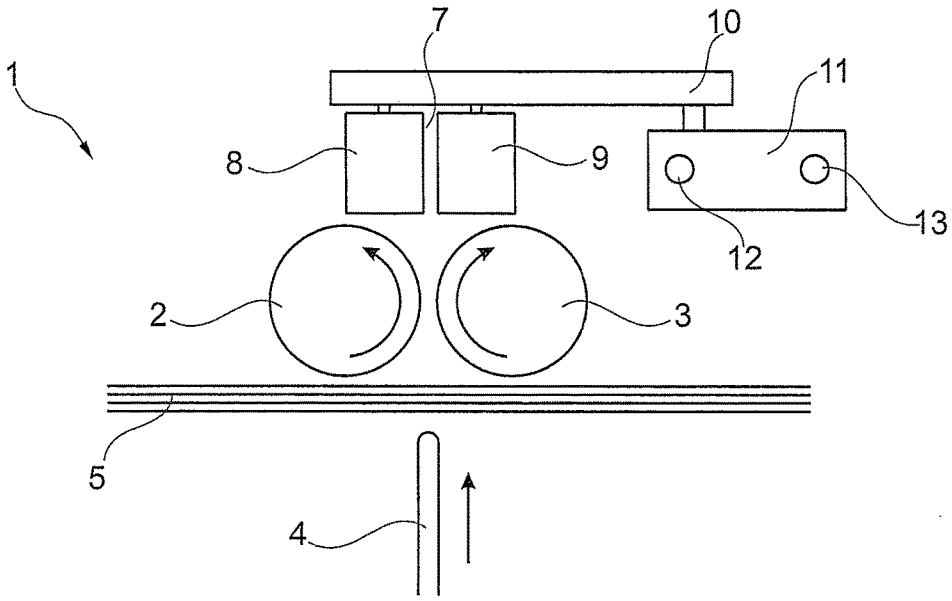
FIG. 1 shows a schematic view of device according to the invention performing a first step of the method according to the invention.

FIG. 1 shows a schematic view of a device 1 according to the invention. This device 1 has pre-folding means having primary rollers 2, 3 and a knife blade 4. According to the method of the invention, a stack of sheets 5 is moved between the rollers 2, 3 and the knife blade 4. The knife blade 4 is moved up, while the rollers 2, 3 are driven. The knife blade 4 will push the center of the stack of sheets 5 between the rollers 2, 3.

Figure 2:
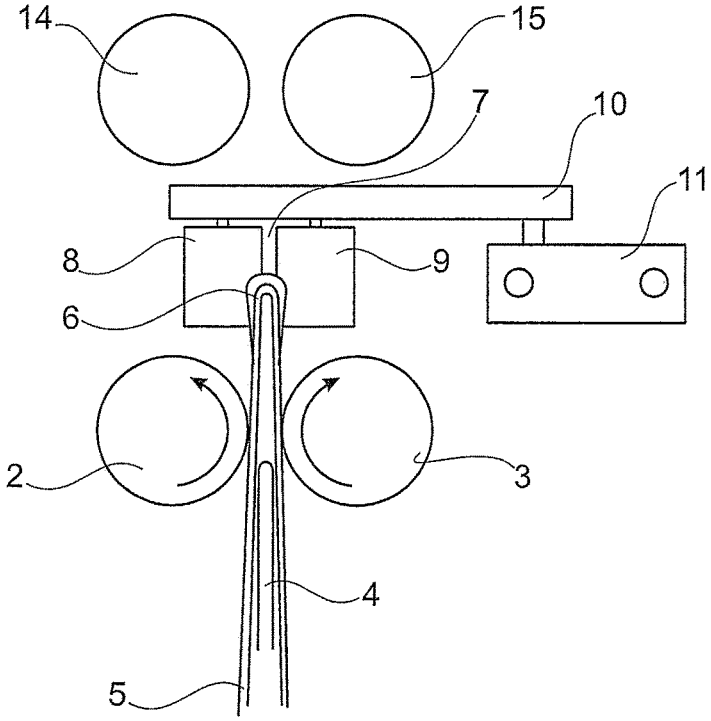
FIGS. 2-5 show schematic views of further steps of the device according to FIG. 1.

As shown in FIG. 2, the stack of sheets 5 is pre-folded between the rollers 2,3 such that a booklet with a back 6 is obtained. The rollers 2,3 keep the pre-folded booklet relative to the frame. The back 6 of the booklet is positioned by the rollers 2, 3 in front of a nip 7 formed by two nip rollers 8,9. The nip rollers 8,9 are arranged to a tiltable arm 10, which is in turn attached to a carriage 11.

The nip rollers 8, 9 are spring mounted such that they are urged to each other by springs, but can also move apart to provide space for the back 6 of a booklet.

Figure 3:
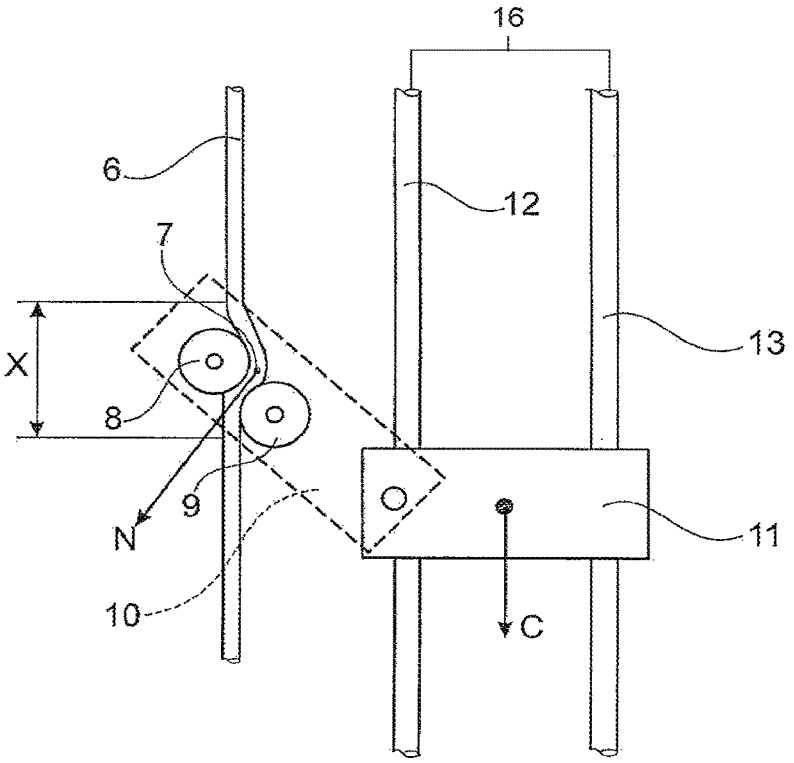

As shown in FIG. 3, the carriage 11 is guided along a frame 16 comprising two rods 12, 13. When the back 6 is positioned in front of the nip 7, the carriage 11 will start to move along the length of the back 6. By the movement of the carriage 11, the back will be inserted into the nip 7 between the nip rollers 8, 9. As a result of the friction, the tiltable arm 10 will tilt relative to the direction of movement C of the carriage 11. This will cause the nip direction N to form an angle greater than zero with respect to an axis that passes through the nip 7 and is perpendicular to the direction of movement C of the carriage 11 within a plane through which the tiltable arm 10 and the carriage 11 are movable. As a result a meandering pattern will be imposed over the length x onto the respective part of the back 6.

Figure 4:
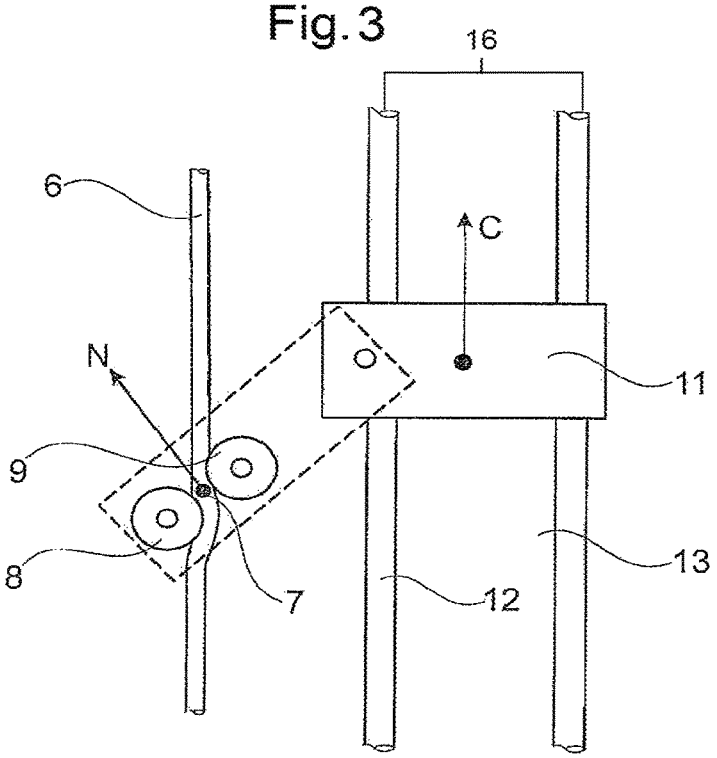

When the carriage 11 has past the full length of the back 6 of the booklet, it will reverse direction and impose again a meandering pattern on the back 6 (see FIG. 4). This will improve the crease at the back 6 of the booklet.

Figure 5:
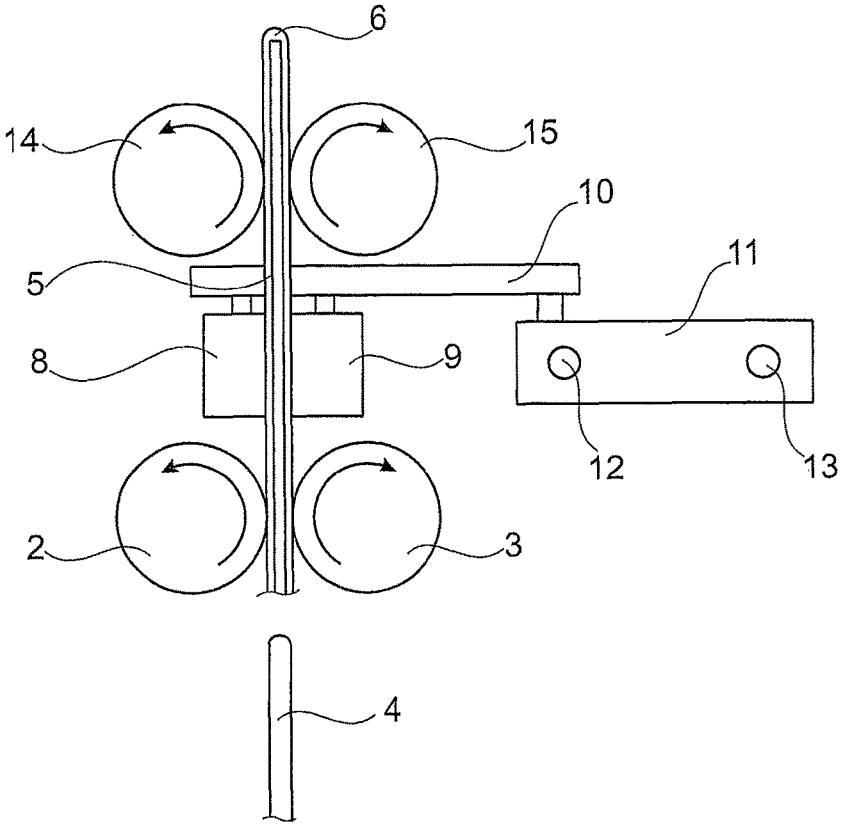

When the carriage 11 has returned to its initial position, the folding process is completed. The booklet 5 (see FIG. 5) will be transported further by driving the primary rollers 2, 3. The back 6 will be brought in to contact with the secondary rollers 14, 15, which will transport the booklet 5 further.

Figure 6:
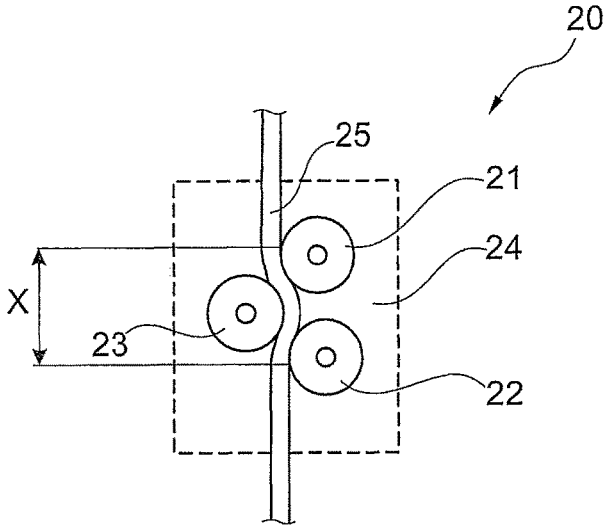
FIG. 6 shows a schematic view of a second embodiment of the device according to the invention.

FIG. 6 shows a second embodiment for the nip 20 of the device according to the invention. This nip 20 can be arranged directly to a carriage and does not need a tiltable arm.

The nip 20 is formed by three rollers 21, 22, 23. The rollers 21, 22, 23 are arranged on a carriage 24. Two rollers 21, 22 are positioned on one side of the booklet 25, while the third roller 23 is positioned on the opposite side of the booklet 25 and in between the rollers 21, 22. With this arrangement a meandering pattern is imposed over the length x to the back of the booklet 25.

The invention claimed is:

1. A device for folding a stack of sheets, the device comprising:

a frame;

means for pre-folding a stack of sheets along a crease line into a main plane such that a booklet with a straight back is obtained;

means for keeping the pre-folded booklet relative to the frame;

a carriage movably arranged to the frame, wherein the carriage is movable parallel to the back of the booklet; and a nip arranged with a tiltable arm connected to the carriage for receiving the back of the pre-folded booklet, wherein a direction of the nip forms an angle greater than zero with respect to a direction of movement of the carriage and wherein the nip direction is mirrored, with respect to an axis that passes through the nip and is perpendicular to the direction of movement of the carriage within a plane through which the tiltable arm and the carriage are movable, upon reversal of the direction of movement of the carriage.

2. The device according to claim 1, wherein the nip comprises at least two spring mounted nip rollers.

3. The device according to claim 1, wherein the means for pre-folding a stack of sheets comprise two parallel primary rollers and a knife plate movable into the nip of the parallel primary rollers.

4. The device according to claim 3, further comprising secondary parallel rollers arranged, relative to the carriage, opposite of the primary parallel rollers, wherein the secondary rollers are for further transporting the folded booklet.

5. The device according to claim 4, wherein the secondary rollers are driven through a unidirectional bearing.

* * * * *